United States Patent [19]

Houser

[11] Patent Number: 4,666,530

[45] Date of Patent: May 19, 1987

[54] METHOD AND APPARATUS FOR EXTRACTING DIRT FROM DUCTING

[76] Inventor: Lee Houser, 805 Emerald Bay, Laguna Beach, Calif. 92651

[21] Appl. No.: 751,030

[22] Filed: Jul. 2, 1985

[51] Int. Cl.[4] ..... B08B 9/00

[52] U.S. Cl. ..... 134/22.1; 15/104.3 SN; 15/104.1 R; 15/230.16; 15/230.19; 15/302; 15/320

[58] Field of Search ..... 134/6, 8, 22.1, 22.18, 134/24, 36, 39, 21; 15/302, 320, 104.2, 104.03, 104.09, 236 C, 104.3 SN, 104.1 R, 104.18, 230.16, 230.19

[56] References Cited

U.S. PATENT DOCUMENTS

| | | | |
|---|---|---|---|
| 2,170,740 | 8/1939 | Volclaning | 15/104.9 |
| 2,735,122 | 2/1956 | Pletcher | 15/104.3 R |
| 3,768,109 | 10/1973 | Wardell | 15/104.2 |
| 3,853,621 | 12/1974 | Sollerud | 134/6 |
| 4,011,100 | 3/1977 | Ross | 134/24 |
| 4,028,136 | 6/1977 | Kanip | 134/8 |
| 4,124,065 | 11/1978 | Leitner et al. | 134/8 |
| 4,324,017 | 4/1982 | Viehe | 15/236 C |
| 4,377,412 | 4/1983 | Viehe | 15/236 C |
| 4,445,248 | 5/1984 | Hart | 15/236 C |

*Primary Examiner*—Andrew H. Metz
*Assistant Examiner*—Sharon T. Cohen
*Attorney, Agent, or Firm*—G. Donald Weber, Jr.

[57] ABSTRACT

A method and apparatus for removing accumulated dirt and dust from ductwork, in-situ. The apparatus includes an auger which is inserted into the ductwork and the power unit for driving the auger. An extraction unit is also connected to the ductwork to remove the dust and dirt which has been produced as a result of the auger.

6 Claims, 6 Drawing Figures

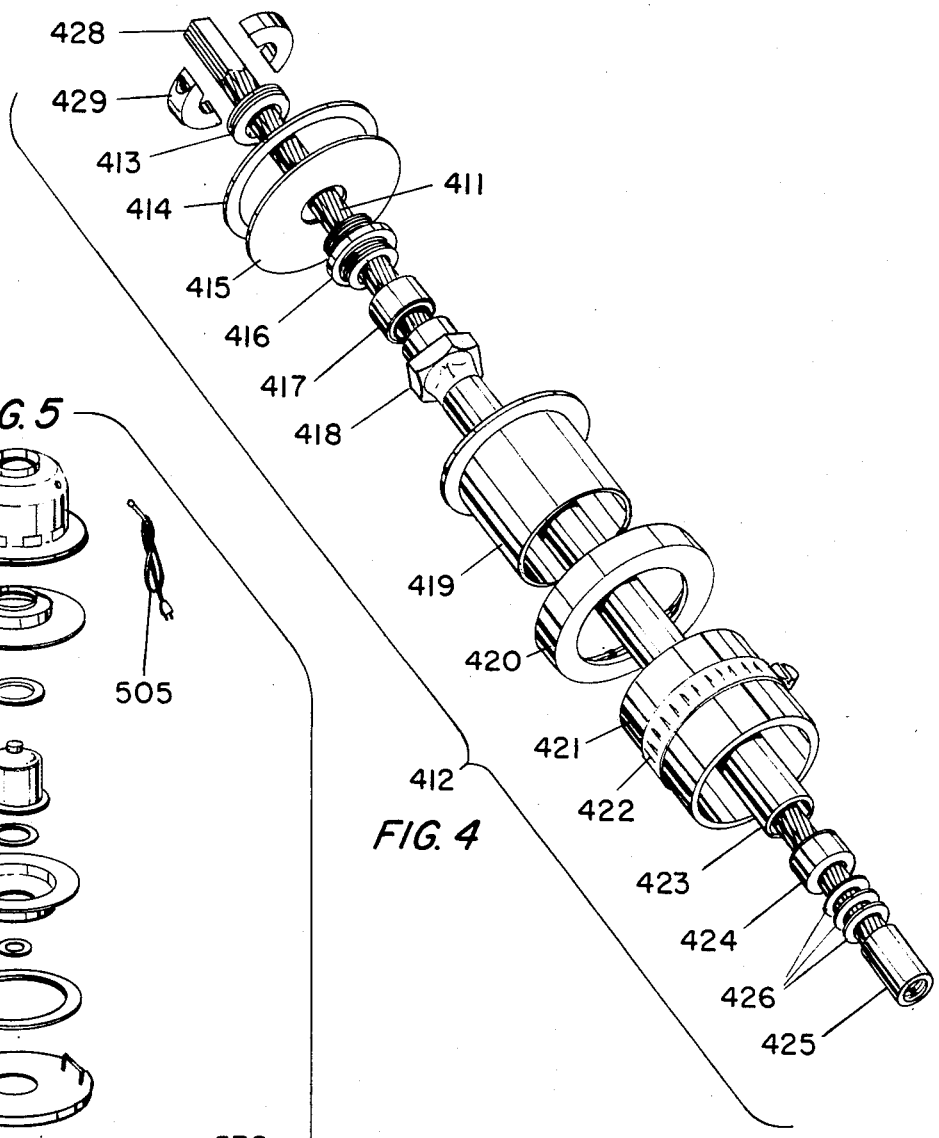
FIG. 4
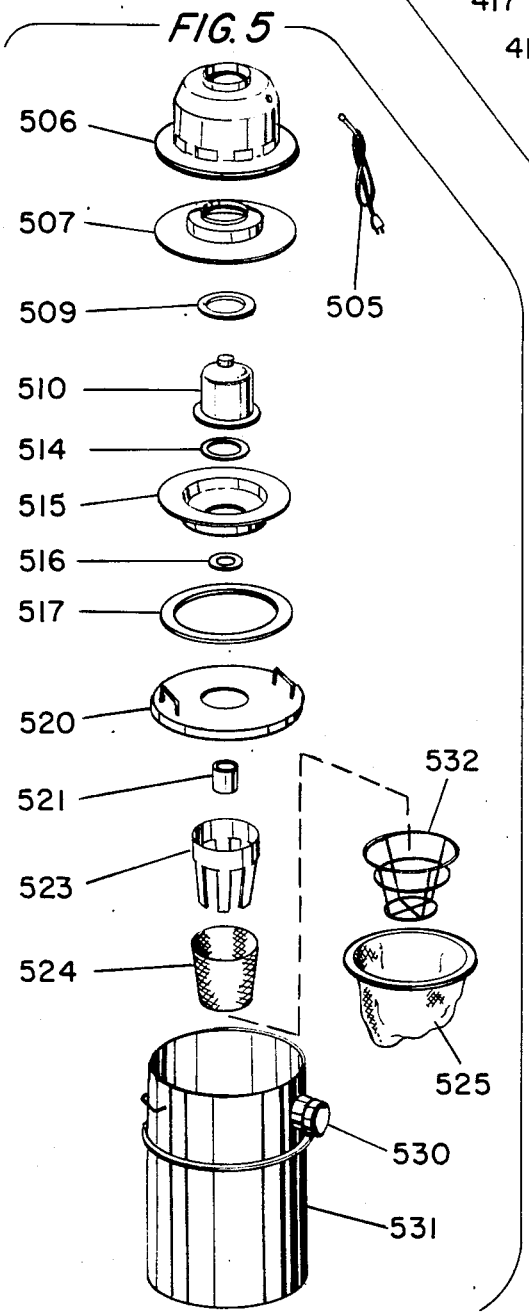
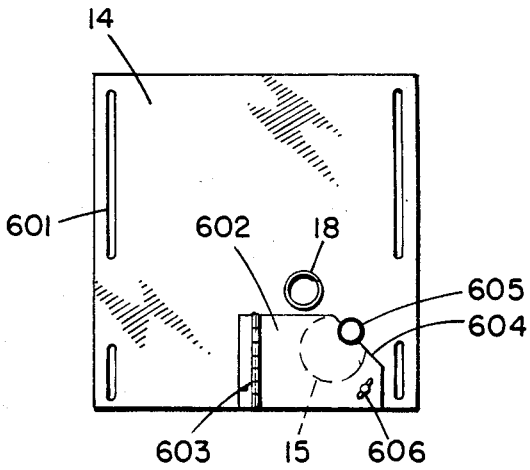
FIG. 6

METHOD AND APPARATUS FOR EXTRACTING DIRT FROM DUCTING

BACKGROUND

1. Field of the Invention

This invention is directed to dirt extraction systems, in general, and, more paticularly to such systems which are used to extract dirt from continuous ductwork without the necessity of disassembling the ductwork or the like.

2. Prior Art.

There are many systems known in the art which are used for extracting dirt from various surfaces. In particular, there are many systems which are known for removing accumulated dirt and debris from tubes or channels.

Perhaps the simplest known device of this kind is a pipe cleaner which is caused to pass through the stem of a smoking pipe to clean sediment from the stem. Other types of cleaning instruments include knives, scrapers and the like which are used to remove grime from the interior of the bowl of a smoking pipe or any other device.

Another well known device of this type is the so called rotary router which is caused to pass through pipes, drains, culverts or other clogged plumbing. However, this device normally includes a cutting tool at the operating end thereof which is used to cut through blockages in the pipe without affecting the pipe itself.

Other types of devices which are capable of passing through pipes or conduits are referred to as "snakes". However, these devices are usually intended to be much smaller than the conduit through which they pass and are used to pull other items (e.g. wire) through the conduits or to clear the conduits in similar fashion to the rotary router noted above.

A rotary device which is known in the art and which is used for cleaning purposes is used in the field of boilers or the like. This device includes a tool which comprises of plurality of flexible, elongated metal cables which have enlarged bodies fixed to the ends thereof. This type of tool is used to clean the inside of boilers by causing the cables to rotate, thereby driving the spheroids at the ends thereof against the boiler to remove the rust and other undesired sediment from the interior of the boiler. However, this tool requires that the component being cleaned is of relatively heavy duty steel or the like which will not be damaged or destroyed by the impact of the cleaning tool.

While there are tools or apparatus of the type described above none of the units has been found acceptable for cleaning ductwork such as found in air conditioning systems or the like. More particularly, many air conditioning ducts include convolutions therein which inhibit the use of cleaning instruments of the type known.

The problems thus encountered with cleaning of such ductwork are significant. The problems can make the cleaning of equipment extremely expensive. For example, on a vessel such as an aircraft carrier, submarine or the like, all of the ductwork must be cleaned periodically because of the nature of the ventilation system operation. That is, the system is, typically, balanced by the configuration of the ductwork and the like. Howewever, when a build-up of dirt and debris occurs in one area, the ductwork and ventilation system becomes out of balance. Th residue situation is aggravated because the clogged portion of the system becomes hotter which is conducive to further build-up of sediment and the like.

In the past it has been necessary to tear down the ventilating ductwork in order to remove the dirt accumulation, and to clean the various segments by hand. This, of course, causes the ventilation system to be inoperative for lengthy periods of time wherein the area to be ventilated (building, ship or the like) is less useful than is desired.

Moreover, it is readily apparent that tearing down an entire ventilation system for the purpose of cleaning of the same and then reassembling the same ventilation system, becomes an inordinate headache as well as requiring considerable expense. It has been projected that the cost of rehabilitating the ventilating system on a single ship the size of an aircraft carrier is in the neighborhood of a quarter of a million dollars. Inasmuch as the cleaning operation is performed on an average of twice a year, the expense can become prohibitive.

Consequently, it is highly desirable to produce a method and apparatus for cleaning ventilation ductwork, or the like, in-situ so that down-time is reduced and the cost of cleaning is minimized. In addition, the method and apparatus must operate in a fashion to do a worthwhile cleaning job without causing damage to the ventilation system.

SUMMARY OF THE INVENTION

This invention is directed to a method and apparatus for extracting accumulations of dirt and debris from ductwork, such as ventilation systems. A power unit is used to drive an auger or cleaning implement which is passed through the ventilation ductwork. An extraction unit is connected to the ductwork by means of a suitable flexible tubing or the like to remove the dirt and debris which has been removed from the ductwork by the operation of the auger.

The auger and the extraction unit device are passed through or connected to the ductwork, in-situ, through an existing opening in the ductwork so that wholesale renovations and disassembly (and consequent reassembly) are not necessary.

The auger is adapted to pass readily through the ductwork but to selectively scour the inside surface of the ductwork by means of flexible strands which will dislodge the dirt but will not damage the interior of the ductwork. The power source drives the auger in a rotary fashion so that the flexible strands extend therefrom due to centrifugal force. The extraction unit removes the debris from the ductwork after it has been dislodged by the auger.

When the cleaning of the ductwork has been completed, the auger and extraction units are removed therefrom, the adaptor plate at the insertion location is removed and the cover or screen is replaced in the ductwork. Thus, no disassembly or reassembly time is required.

BRIEF DESCRIPTION OF THE DRAWINGS

FIG. 4 is a schematic representation of another embodiment of the apparatus shown in FIG. 2.

FIG. 5 is an exploded view of a portion of the retrieval apparatus of the instant invention.

FIG. 6 is a detailed portion of the closure door for the apparatus of the instant invention.

DESCRIPTION OF A PREFERRED EMBODIMENT

Figure 1:
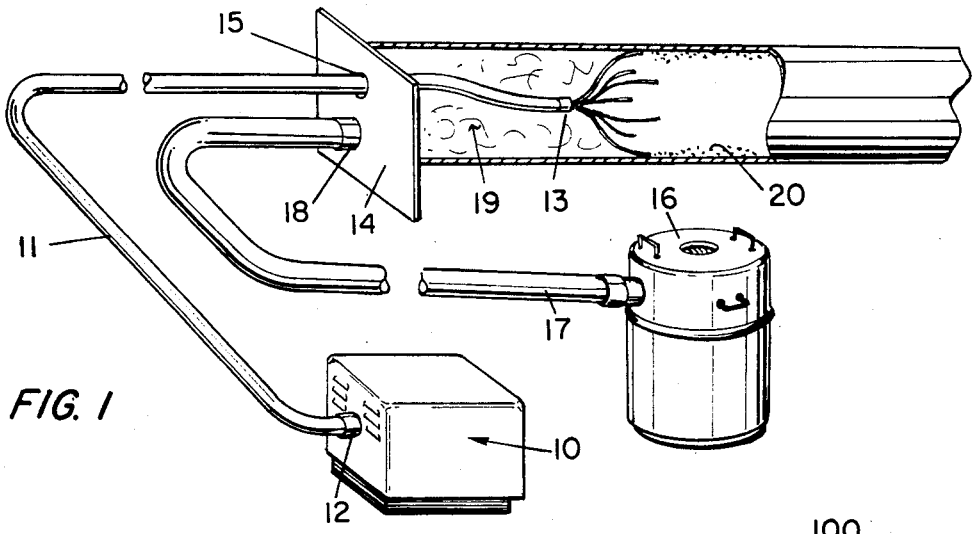
FIG. 1 is a schematic diagram of the system of the instant invention.

Referring now to FIG. 1, there is shown a schematic representation of the apparatus of the instant invention. This apparatus includes a suitable power unit 10 which is capable of providing a drive mechanism which can be attached to a power shaft 11 by means of the coupling apparatus 12 which produces a rotary drive through the shaft. The power unit 10 can be powered by gas or electricity. Of course any other suitable arrangement can be made. The coupling 12 is a suitable coupling by which the power shaft 11 which is a standard rotary drive cable can be connected to and driven by power unit 10. The power shaft 11 is passed through an aperture 15 in adaptor plate 14 and connected to the auger 13. The auger 13 is shown in greater detail hereinafter but includes an apparatus connected to the power shaft 11 and driven thereby in a rotary fashion. The adaptor plate 14 is placed over a suitable access panel or other entry area in ductwork 20. The adaptor plate 14 permits access to the interior of the ductwork 20 while maintaining the basic integrity of the overall ventilation or ductwork system. Using the adaptor plate has several advantages. For example, the dust and dirt are confined within the ductwork and are not released into the general environment. In addition, by maintaining the ductwork system integrity the extraction tool can create a closed-system retrieval environment (i.e. partial vacuum) in the vicinity of the auger whereby dirt extraction is facilitated. In a preferred embodiment a closure door can be mounted on plate 14 adjacent aperture 15 to provide a seal around the cable 11.

Likewise, by maintaining the integrity of the ductwork system, the ductwork can remain operable. As an example, a ventilating system can be maintained in continuous operation during the cleaning operation. This is not feasible in the prior art.

The extraction unit 16 is, typically, a vacuum apparatus which is used to withdraw the accumulated dust and dirt out of the ductwork 20. Appropriate switches and lights can be added to the unit 16. A suitable flexible tubing 17 is connected to the extraction unit 16 by any appropriate coupling apparatus. The tubing 17 can be attached to an aperture 18 in adaptor plate 14. In an alternative embodiment, the flexible tubing 17, or a portion thereof can be inserted through aperture 18 into duct 20 and placed adjacent to the auger 13 to expedite the dirt removal process In operation, an existing access panel or door, such as grill or the like, is removed from the ductwork 20. The power shaft 11 is passed through aperture 15 in adaptor plate 14 while the flexible tubing is passed through aperture 18 in adaptor plate 14. The auger 13 is then mounted on the end of shaft 11 if need be. In some cases, the auger is attached to the shaft 11 before being passed through the adaptor plate 14. Obviously, the size of the apertures 15 and 18 can determine when and how the shaft 11 and tubing 17 are passed through the appropriate apertures.

The adaptive plate 14 is then mounted onto the ductwork in the place of the access panel which has been removed. The flexible tubing 17 is attached to the extraction unit 16 and the power shaft 11 is connected to the power unit 10 by means of coupling 12.

At this point both the power unit and the extraction unit are activated. In particular, the extraction unit begins to apply a vacuum internally of the ductwork 20 to extract any dust or dirt which is capable of being removed. At the same time, the auger 13 is activated in response to controls by the operator. When the power unit 10 causes power shaft 11 to be activated, shaft 11 rotates at a relatively high rate of speed, e.g. at the rate of 1725 rpm. This rotary motion is transferred and transmitted to auger 13 which also tends to rotate. As the auger 13 rotates, the fingers or strands which extend therefrom are also caused to rotate. These strands tend to fly outwardly toward the interior surface of ductwork 20 as a result of centrifugal force on the strands. By properly selecting the length of the strands at auger 13 relative to the internal dimensions of ductwork 20, the strands will strike the interior surface of ductwork 20 and thereby dislodge any dirt or debris which has accumulated in the ductwork.

Also, by giving consideration to the dimensions of the strands and the ductwork, the auger will tend to be self-centering relative to the ductwork wherein cleaning of the ductwork proceeds in a orderly and uniform fashion. As dirt and dust is dislodged from the interior surface of the ductwork and tends to accumulate as suggested by dust and dirt 19, the extraction unit tends to vacuum this material out of the ductwork through the flexible tubing 17 and into the extraction unit 16.

While not shown, suitable carrying straps can be attached to the power unit 10 and the extraction 16 in order to enhance the portability of the apparatus.

Figure 2:
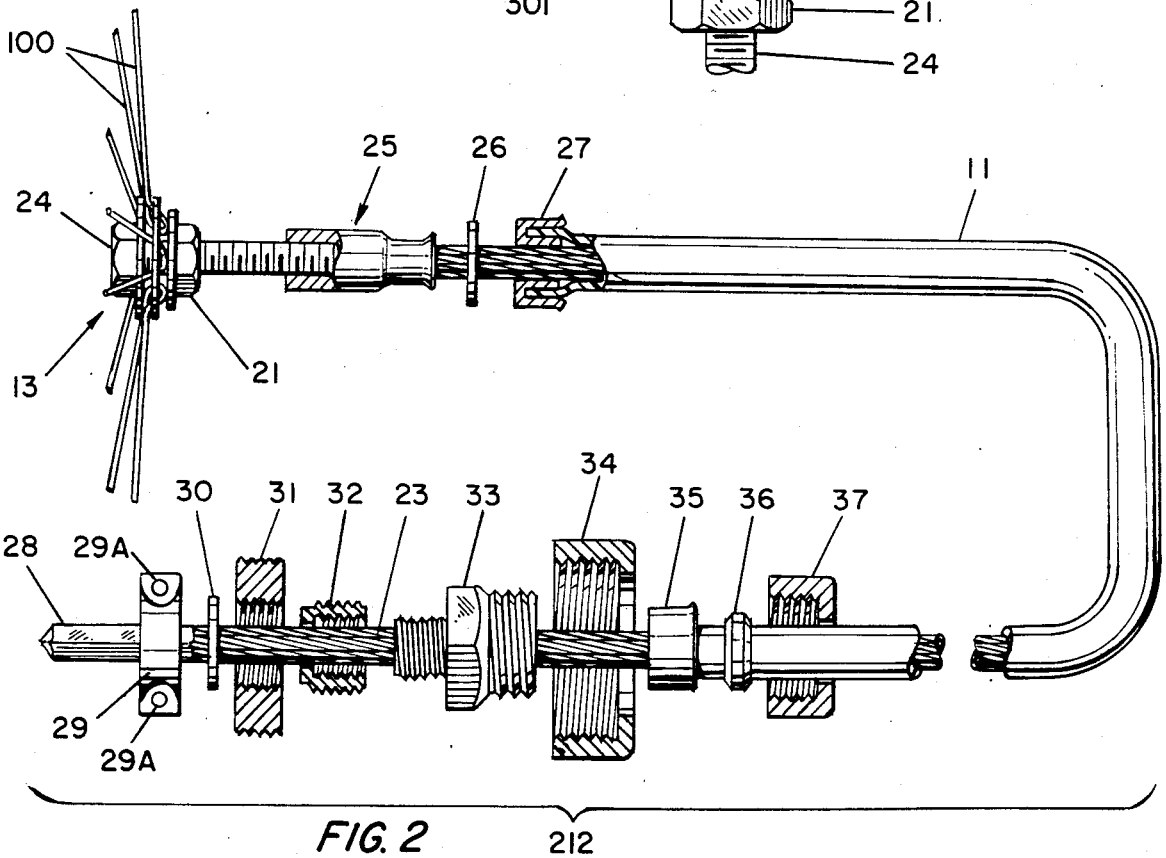
FIG. 2 is a schematic representation of the power shaft with the electric drive connection and the auger at the opposite ends thereof.

Referring now to FIG. 2, there is shown one embodiment of the power and cleaning apparatus of the instant invention. In particular, FIG. 2 shows the power shaft 11 together with the coupling arrangements for coupling to the power unit 10 and to the auger 13.

The coupler 12 of FIG. 1 is shown in an exploded view as coupler 212 in FIG. 2. The coupler 212 includes the rectilinear end 28 which is used to connect the drive shaft to the drive element in power unit 10. The rectilinear end 28 is, typically, square in configuration but can be any suitable size and shape.

An adjustable split collar 29 is mounted to the cable system in the usual fashion. That is, the portions of the collar 29 are joined together by screws 29A or the like. Collar 29 serves the purpose of retaining the fitting 28 to the drive cable. In addition, the collar 29 tends to control the positioning of fitting 28 relative to the drive source (not shown). The internal drive cable 211 also passes through the center of thrust washer 30 which is used to reduce back torque and temperature build-up due to friction. Washer 30 is also arranged to mate with one end of the threaded fitting 32 which includes threads on both the internal and external surfaces thereof.

In particular, the end of fitting 32 passes through the center aperture of spring washer 30. The fitting 32 is also threadedly engaged with the threads on the interior surface of the central opening in spacer 31 which, in the preferred embodiment, can be a plastic spacer. The fitting 32 is threaded into spacer 31 sufficiently to engage with washer 30.

The reducing fitting 33 has one end which is threaded to engage with the interior threads o fitting 32. The other end of fitting 33 is also threaded to receive a cap 37 as described hereinafter. The portion of the fitting 33 which is intermediate the two threaded ends, is arranged in a hex nut arrangement so that ready adjustment of the fitting is permissible.

The external connector nut 34 is adapted to pass over the cable 211, to encompass the washer 30, spacer 31, fittings 32 and 33 and to connect to a suitable fitting on the power source 10. Thus, connector nut 34 causes the cable fitting to be maintained in connection with the drive means in power source 10.

The sheath fitting 35 is adapted to slip over the end of the drive cable 211 and to pass through connector nut 34 to fit within the end bore of fitting 33. The outer casing of the drive shaft 11 is thereby joined to the casing end fitting 35.

A gasket 36, typically of a plastic material, also surrounds the outer casing 11 and mates with the casing end fitting 35. The cap nut 37 is arranged to pass along the casing 11 to capture the gasket 36 and the end fitting 35 therein when the cap nut 37 is threadedly engaged with fitting 33. Thus, the casing 11 is secured through the coupling apparatus 212 which also secures the drive cable 211 to the drive source.

At the other end of the drive cable, another casing end fitting 27 is mounted over the sheath or casing 11 to provide a securement therefor. Casing end fitting 27 may be similar in shape and configuration to casing end fitting 35.

A thrust washer 26 is disposed around the drive cable 211 and serves to eliminate back torque and reduce friction, similar to washer 30.

The end coupling 25 is joined to the flexible drive cable 211 through a suitable friction or force fit. In addition, other types of fittings can be applied, if desirable.

Coupling 25 includes an internal threaded arrangement which is adapted to receive the threaded portion of the bolt 24 which forms a part of the auger 13 (see FIG. 1). The auger 13 also includes washers 22 and 23 which are placed over bolt 24 as well as a nut 21 which is threadedly engaged with the bolt to retain the washers 22 and 23. A plurality of strands 100 are inserted into appropriate apertures in anchor washer 23 and secured between washers 22 and 23 which are pushed together by tightening on nut 24. (This assembly is discussed in greater detail infra.) The nut 24 is threadedly engaged with coupling 25 so that the auger 13 is driven, via cable 211, by the power unit 10. In a preferred embodiment, bolt 24 is "bottomed" within coupler 25 so that the torque and inertial forces on start-up and shut-down do not cause bolt 24 to become loosened and disengaged from coupling 25.

Figure 3:
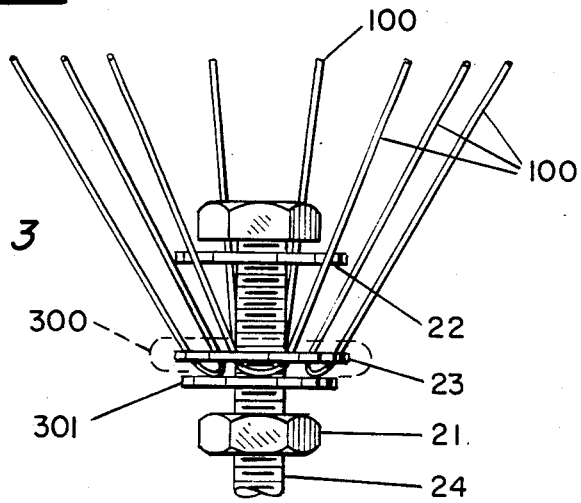
FIG. 3 is a detailed showing of the auger portion of the invention in a partially assembled condition.

Referring now to FIG. 3, there is shown a partly disassembled view of the auger of the instant invention. In this view, the bolt 24 is clearly depicted as are the washers 22, 23 and 301.

The washer 23 is defined to have a plurality of apertures therethrough essentially uniformly spaced between the outer periphery of the washer and the periphery of the central aperture in the washer. The washer can be made of metal, plastic, or any other suitable material. These smaller apertures are arranged to receive the strands 100 therethrough. In a typical case, the strands can be formed of a flexible, yet strong, fiber such as nylon, or the like. The strands can vary in length and thickness depending upon the specific application to which they are being put. Moreover, in a preferred embodiment, the strands are formed of a material which will not produce sparks when struck against the inner surfaces of the ductwork. This avoids the possibility of unwanted fires or explosions in the loosened debris.

After the strands are threaded through the apertures in washer 23, a suitable encapsulating material 300 is applied to the strands and washer 23. This material affixes the strands to the anchor ring (washer 23) and serves to cushion the pressure on the strands at the interface with the washer 23. Also, the plastic material 300 aids in properly positioning the strands during operation thereby relieving stress thereon. Thereafter, nut 21 is tightened on bolt 24 wherein the strands 100 are squeezed between washers 22 and 23. In addition, the strands are caused to "fan-out" to produce a plurality of radially extending strands. The number of strands which extend radially is a function of the type of material involved and the application to which the invention is being put. However, in the preferred embodiment, eight (8) strands extend outwardly from auger 13.

As shown in FIG. 3, strands 100 can be a continuous loop of strands which, after having been threaded through washer 23 are then cut uniformly at the ends extending away from the washer. Of course, each strand 100 can be individually measured, cut and inserted into the washer 23 in a U-shaped configuration. Moreover, it is obvious that other means can be used for mounting the strands which could be individual components which are joined to the washer mechanism 23 by means of knotted ends or the like.

Of course, any suitable arrangement can be made for retaining the flexible strands at the auger mechanism. The specific arrangement of washers and strands is illustrative of a preferred embodiment but other techniques can be utilized, if so desired.

The auger mechanism automatically adapts to various shapes and diameters of ducting. For example, the auger 13, under rotation, can enter through a 2" diameter cylindrical duct and move continuously on to a 6" square or rectangular duct. The centrifugal force causes the auger fingers 100 to move outwardly from the center of rotation while tracking the internal perimeter of the ducting and efficiently removing, debris regardless of diameter or shape factor. The centrifugal force also causes the auger 13 to track the center of the duct, in a self centering fashion, which assures efficient cleaning over 360° of the ducting perimeter regardless of shape, diameter, or directional changes in ducting.

Referring now to FIG. 4, there is shown an alternative embodiment for the cable drive assembly mechanism. In this case, many of the parts are similar to the first noted embodiment. For example, the cable end 428 is, again, a square shaped member for mounting into the drive mechanism in the power source 10. A split collar or clam 429 is also utilized. The internal portion of drive cable 411 is joined to the cable fitting 429.

The internal cable 411 passes through a nut 413, a rubber washer 414 and a steel washer 415. Nut 413 is threadedly engaged with one end of a nipple 416. The other end of nipple 416 is engaged with grommet 417 (similar to fittings 27 and 35 in FIG. 2) and nut 418 to form the appropriate spacer and centering mechanism for controlling the position of cable 411.

In addition, the flanged tube retainer 419 is adapted to mate with steel washer 415 and to be joined thereto by means of the bayonet or screw fitting 420 which slides over the tube portion of retainer 419, engages the flange and then interacts with the fittin on the housing for power source 10.

A strain relief support element 421 is inserted into and engaged by the fitting 420. A clamp 422 may be utilized in some cases if the strain support 421 is a split sleeve or the like. The purpose of the strain support 421 is to prevent the cable 411 (which passes through the outer casing 423) from becoming bent or kinked as it extends from the power source 10. This strain relief support provides for greater life-time for the cable. The grommet 424, the thrust washer 426 and the attachment fitting 425 are similar to the housing 25 and thrust washer 26 shown in FIG. 2.

FIG. 5 is an exploded view of the retrieval or extraction unit 16 shown is FIG. 1. In particular, the unit comprises a tank 531 which is the outer housing for the extraction unit. An inlet fitting 53O is provided in the tank to provide a connection to the extraction tubing 17 shown in FIG. 1.

This fitting may include an internal deflector which directs debris to the bottom of the tank 531.

Internally of the tank 531 is mounted a suitable filter and frame which is fabricated, in a preferred embodiment, of a polypropylene material. A foam filter 524 and a filter support 523 are mounted internally of the filter member. A suitable filter cage 532 is used to mount the filter 524. A float 521 is mounted within the filter cage 523 to shut off the vacuum 16 in the event fluids are drawn into the system.

The filter and internal mechanisms are mounted to and depend from cover 520 which is fastened over the edge of tank 531. Suitable gaskets 516 and 517, and upper and lower motor mounts 507 and 515 are used to mount the motor 510 to the cover 520. The motor is enclosed by motor housing 506. Other necessary nuts, bolts, washers and assorted hardware, as well as appropriate seals and electrical connections, are included in the apparatus.

Thus, the retrieval unit operates in the nature of a vacuum cleaner so that when it is rendered operative, the motor creates a vacuum force through the tank 531 and the flexible coupling 17. Thus, any dirt or debris is moved from the ductwork 20 (see FIG. 1) and drawn into the tank 531. By using the cage, filter and frame arrangement, the dirt and debris is trapped in the tank. By using a polypropylene filter apparatus, the dirt and debris usually will not adhere to the filter but will fall directly into the bottom of the tank to be disposed of.

Referring now to FIG. 6, there is shown a more detailed illustration of a door which is used to provide closure of the ductwork being cleaned.

The plate 14 is shown as before and includes slots 601 for adjustably mounting the plate 14 to the ductwork. Aperture 18 is provided at about the center of plate 14 and is adapted to receive the exhaust tubing 17. The opening 15 (shown in dashed outline) is provided to receive the auger 13 together with the power shaft 11. A door 602 is hingedly mounted to plate 14 (by hinge 603) and selectively covers over opening 15. Door 602 is seen to have a diagonal cut 604 so that a portion of one corner is missing. At this cut 604, there is mounted a split rubber grommet 605 into which is inserted the power shaft 11 (see FIGS. 1 and 2). A suitable fastener 606 is provided to lock door 602 to plate 14 in the closed portion (as shown).

In this embodiment, door 602 is unlocked (at fastener 606) and opened on hinge 603. The auger is passed through opening 15 and the power shaft is inserted into split grommet 605. When the door 602 is closed and locked, grommet 605 closes tightly on shaft 11. With exhaust tube 17 in place on opening 18, the plate 14 provides an excellent seal for the ductwork wherein the cleaning operation can take place without creating a large mess.

Of course, by making the adaptor plate 14 in FIG. 1 relatively air-tight, the vacuum system in the retrieval portion of the apparatus operates much more efficiently.

Thus, there is shown and described a new and unique apparatus and method for retrieving dirt and debris from ductwork without the necessity of removing the ductwork, cleaning same and then reassembling the ductwork. The cost of cleaning such ductwork can be materially reduced. Moreover, down-time of the system can, therefore, be mimimized.

While preferred embodiments of the coupling systems of the invention have been described, other coupling devices and techniques can be utilized. The drive cable has been defined as a steel cable surrounded by an outer casing or sheath. Of course, any suitable type of drive-shaft can be utilized. The auger or cleaning component has been defined as utilizing a bolt, a plurality of washers and a plurality of flexible strands extending therefrom. The number of strands can be altered so as to provide a most efficient arrangement. Also, the length and position of the strands can be varied and adjusted in accordance with preferred operations and applications.

In a similar fashion the type of extraction unit can be varied. A cylindrical tank type has been shown but other types are available. Moreover, other types of materials may be included in terms of the types of debris or dirt which are expected to be extracted from the ductwork.

It should be understood that the apparatus and methods which have been shown and described herein are illustrative of the invention and are not intended to limitative thereof. Clearly, those skilled in the art may conceive of variations or modifications to the invention. However, any such variations or modifications which fall within the purview of this description are intended to be included therein as well. The scope of the invention is limited only by the claims appended hereto.

I claim:

1. A method of removing dirt and debris from the interior of ductwork comprising, inserting a rotatable non-metallic cleaning element including a plurality of strands of flexible fiber material into a substantially continuous, closed system ductwork and moving said cleaning element through said ductwork, inserting an exhaust element into said ductwork adjacent to or behind said cleaning element, rotating said cleaning element so that centrifugal force causes said element to increase in radial dimension by causing said strands to extend radially outwardly in order to be axially aligned within said ductwork and to be in rotating contact with the inner surface of said ductwork thereby to dislodge dirt and debris from the interior surface of said ductwork without damaging said ductwork, and applying suction to said exhaust element thereby to cause the dislodged dirt and debris to be drawn into said exhaust element and out of said ductwork in a controlled manner.

2. A cleaning apparatus especially adapted for cleaning of ductwork of various sizes and shapes comprising, a cleaning tool with a plurality of flexible finger means comprising strands of fiber which extend radially therefrom, drive means connected to said cleaning tool and adapted to rotatably drive said cleaning tool thereby to provide a centrifugal force to said flexible finger means whereby said cleaning tool can adapt to the size and shapes of the ductwork to be cleaned, said drive means includes flexible drive shaft means adapted to be connected to a drive source, exhaust tubing means, vacuum means attached to said exhaust tubing means, and closure means which can be attached to the ductwork to be cleaned, said closure means includes apertures therein for snugly receiving said drive means and said exhaust tubing means.

3. The device recited in claim 1 wherein, said flail means extends through said flail aperture, and adhesive means for securing said flail means to said anchor means.

4. The apparatus recited in claim 2 including, seal means for sealing the aperture in said closure means which receives said drive means.

5. A cleaning device which is adapted to automatically alter its size when operational in response to a driving means for cleaning dirt and debris from the interior surface of ductwork of various shapes and sizes comprising, at least one flexible flail means, said flexible flail means includes at least one elongated strand of flexible non-metallic material, an annular support for mounting and returning said frail means and means having a central aperture therethrough and at least on flail aperture intermediate said central aperture and the perimeter of said annular support means in order to receive said strand therethrough, bolt-like mounting means for mounting said annular support means so that said strand in said flail means extends outwardly therefrom, said mounting means is threaded and is adapted to pass through said central aperture in said annular support means, and washer-like means disposed on each side of said annular annular support when mounted on said mounting means and adapted to retain said annular support with said flail means radiating from said mounting means.

6. The device recited in claim 5 wherein, said flail means includes a plurality of strands of a nylon-like material.

* * * * *